US008257100B2

(12) United States Patent
Lu et al.

(10) Patent No.: US 8,257,100 B2
(45) Date of Patent: Sep. 4, 2012

(54) CARD CONNECTOR

(75) Inventors: Shi-Xiang Lu, Guang-Dong (CN); Feng Zhu, Guang-Dong (CN); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 192 days.

(21) Appl. No.: 12/872,294

(22) Filed: Aug. 31, 2010

(65) Prior Publication Data

US 2012/0052728 A1 Mar. 1, 2012

(51) Int. Cl.
*H01R 29/00* (2006.01)

(52) U.S. Cl. ..... 439/188

(58) Field of Classification Search ..... 439/188, 439/189, 326, 331, 630, 489, 159, 607.55
See application file for complete search history.

(56) References Cited

U.S. PATENT DOCUMENTS 6,431,893 B1 * 8/2002 Chang et al. ..... 439/188
6,951,470 B1 * 10/2005 Huang ..... 439/159
7,364,471 B2 * 4/2008 Takahashi et al. ..... 439/680
7,416,428 B1 * 8/2008 Hung et al. ..... 439/188
7,682,197 B2 * 3/2010 Wang ..... 439/630
7,837,488 B2 * 11/2010 Wu ..... 439/188
7,887,348 B2 * 2/2011 Matsumoto et al. ..... 439/188
7,955,103 B2 * 6/2011 Konno et al. ..... 439/188
7,972,156 B2 * 7/2011 Zhou et al. ..... 439/188
2004/0219813 A1 * 11/2004 Chang ..... 439/188

* cited by examiner

*Primary Examiner* — Alexander Gilman
(74) *Attorney, Agent, or Firm* — Cheng-Ju Chiang

(57) ABSTRACT

A card connector includes an insulating housing, a plurality of contacts, a projection and a detecting contact set. The insulating housing includes a bottom wall, a right wall and a left wall for defining a receiving space. The contacts are received in the insulating housing. The projection is protruded from the right wall and into the receiving space, which includes a slanting surface slanted relative to the right wall. The detecting contact set is fixed in the insulating housing, which includes a contacting arm protruding from the slating surface of the projection and into the receiving space. Due to the contacting arm of the detecting contact set is protruded from the slanting surface of the projection in the receiving space, the detecting contact set will be actuated while a card is inserted into the receiving space correctly and completely. Since, the detecting accuracy of the card connector is improved.

20 Claims, 6 Drawing Sheets

CARD CONNECTOR

BACKGROUND OF THE INVENTION

1. Field of the Invention

The present invention relates to a card connector, more specifically, to a memory card connector with accurate card detecting means.

2. The Related Art

Generally, data can be exchanged between two or more consumer electrical devices through a memory card. For accessing and calculating data of various electrical devices, various memory cards are developed. It is common that MS card (Memory Stick), SD card (Secure Digital), mini SD card, micro SD card, MMC (Multi Media Card) card, SIM card (Subscriber Identity Module), etc are publically use. A card connector is a necessary component of the electrical devices for receiving a memory card and transmitting data between the memory card and the electrical devices. For a long term use purpose, the card connector with strong structure is required for achieving extension of the electrical devices.

It is common that contacts with in the card connector will be damaged due to user's improper insert operation of memory card such that the memory card will work erroneously and unable to transmit data.

A conventional memory card connector is mounted on a printed circuit board within the electrical device for receiving a memory card. The memory card connector includes an insulating housing and a metal shell shielding and engaging to the insulating housing. The insulating housing defines a receiving space for receiving the memory cards and a plurality of grooves for receiving contacts. One end of each contact is soldered to the printed circuit board and the other end connects to a corresponding conductive pad of the memory card. A detecting contact is further positioned in the receiving space of the insulating housing of the memory card connector for detecting memory card in order to allow access of the memory card.

However, the shell will separate from the insulating housing after a long term use because the shell without soldering to the printed circuit board only engages to the insulating housing. Because the detect contact is positioned at a middle portion of the receiving space of the insulating housing of the memory, the detect contact will be actuated before the memory card is completely inserted into the receiving space or the memory card is improperly inserted into the receiving space such that the memory card will work erroneously. It is unstable to transmit date to or from the memory card through the memory card. Moreover, data saved in the memory card will be destroyed.

SUMMARY OF THE INVENTION

An object of the present invention is to provide a card connector with better detecting accuracy.

According to the invention, the card connector includes an insulating housing, a plurality of contacts, a projection and a detecting contact set. The insulating housing includes a bottom wall, a right wall and a left wall for defining a receiving space therebetween. The contacts are received in the insulating housing and extended into the receiving space.

The projection is protruded from the right wall and into the receiving space. The projection includes a slanting surface slanted relative to the right wall. The detecting contact set is fixed in the insulating housing. The detecting contact set includes a contacting arm protruding from the slating surface of the projection and into the receiving space.

Due to the contacting arm of the detecting contact set is protruded from the slanting surface of the projection in the receiving space of the insulating housing, the detecting contact set will be actuated while a card is inserted into the card connecter correctly and completely. Since, the detecting accuracy of the card connector is improved.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
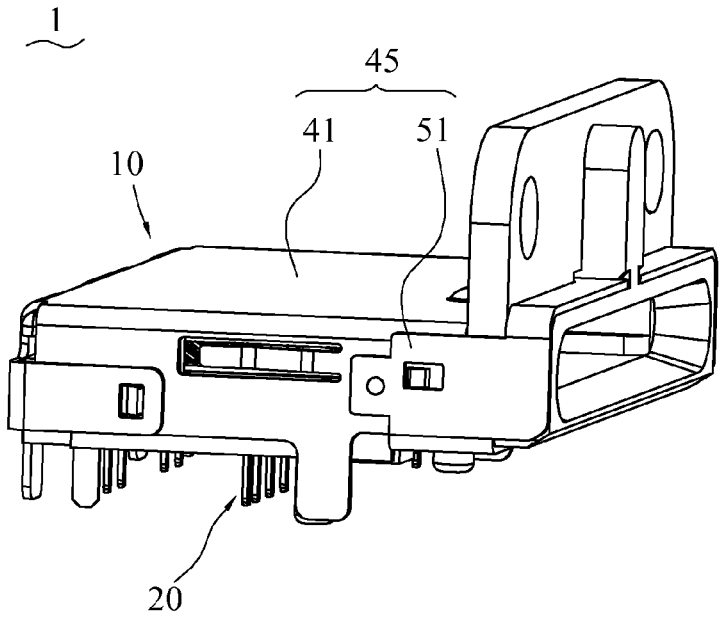
FIG. 1 is a perspective view of a preferred embodiment of a card connector according to the present invention.
Figure 2:
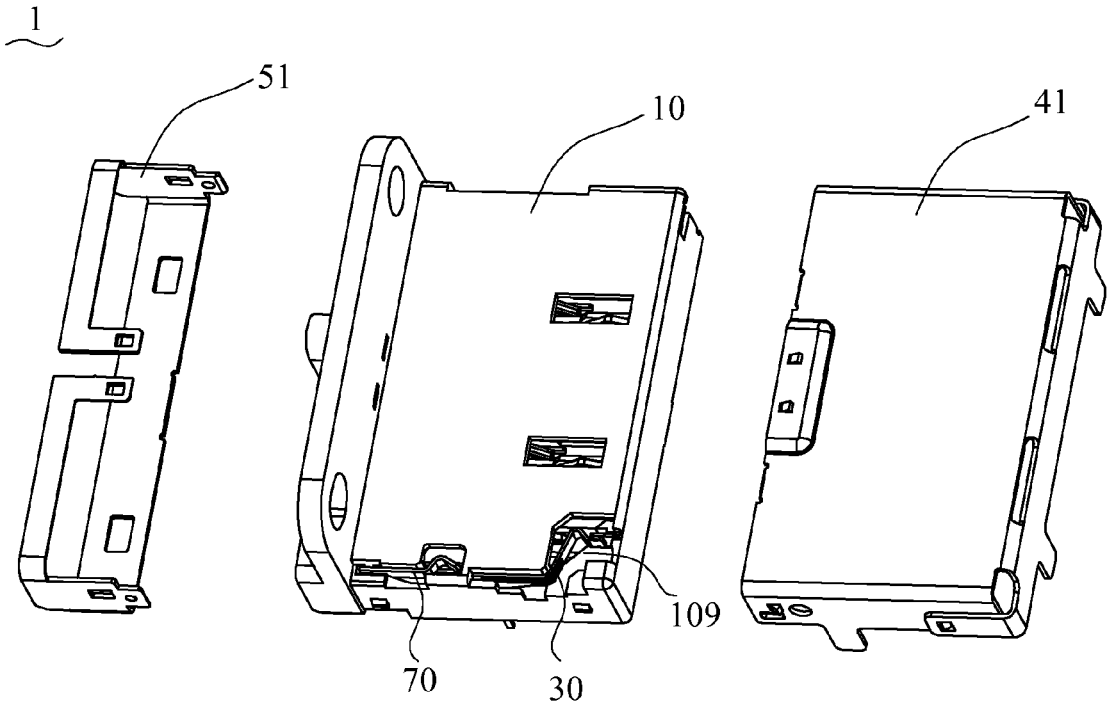
FIG. 2 is an exploded view of a shell of the card connector in FIG. 1.
Figure 3:
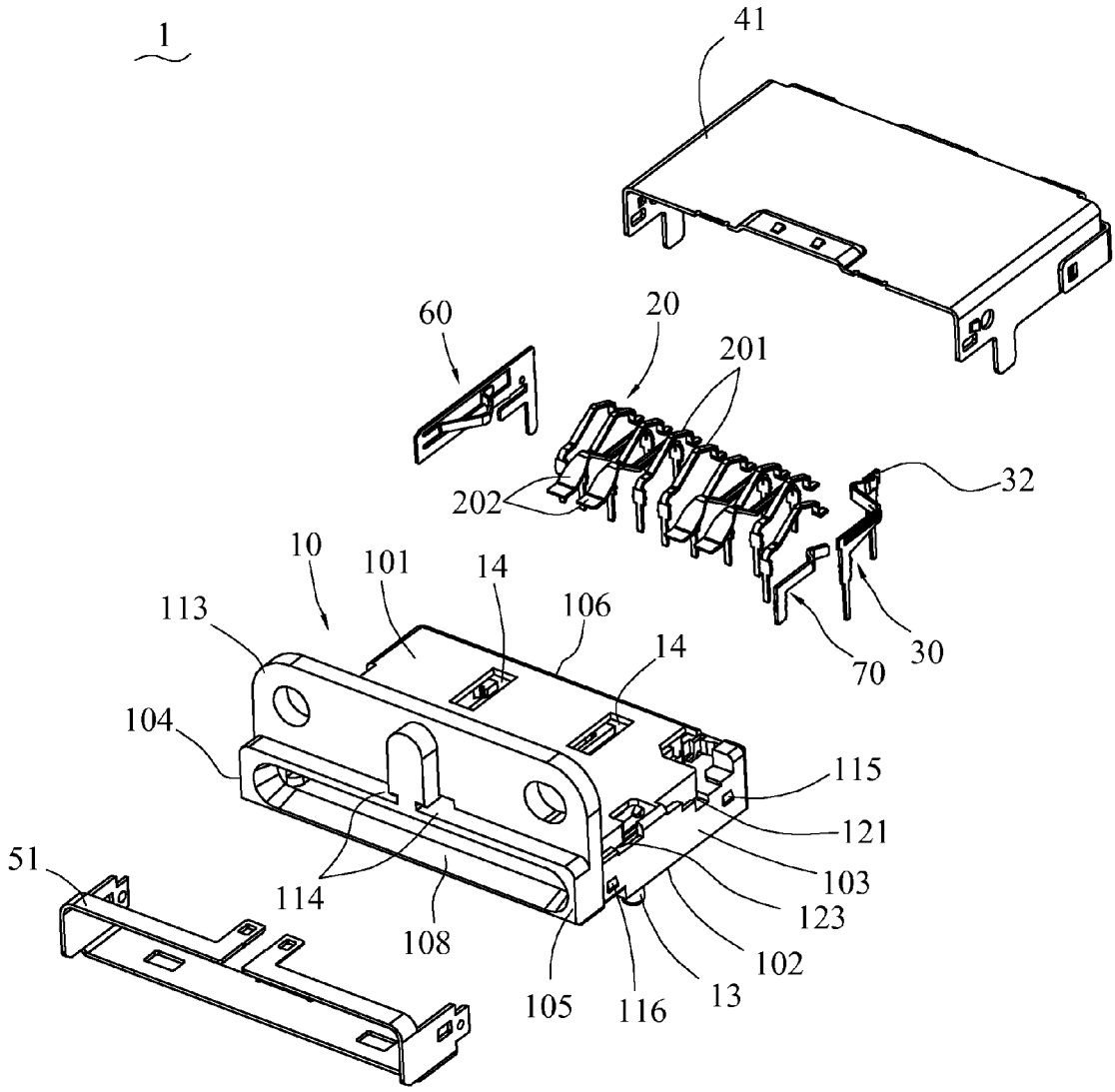
FIG. 3 is an exploded view of the card socket connector in FIG. 1.
Figure 4:
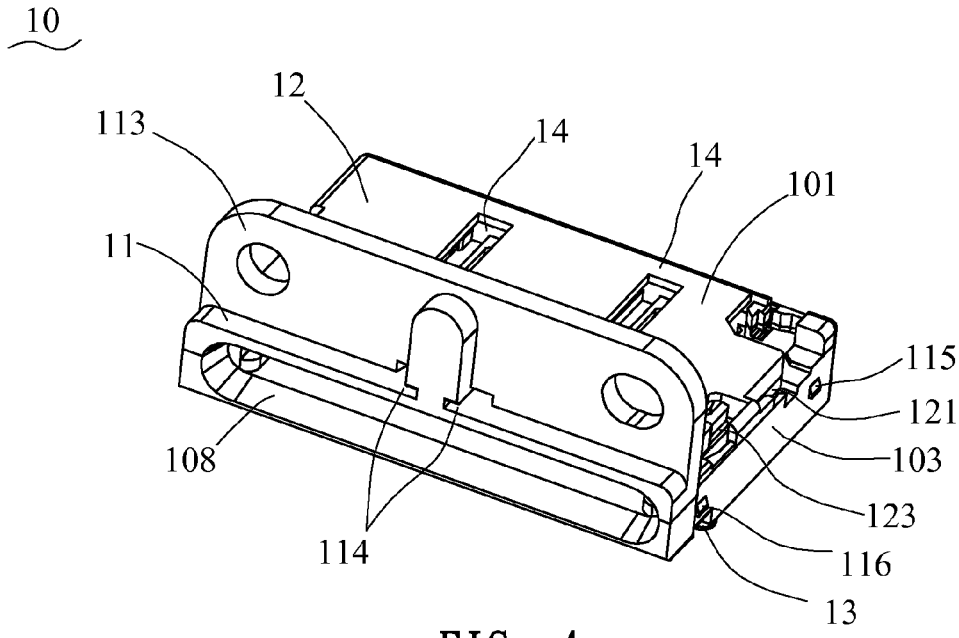
FIG. 4 is a perspective view of an insulating housing of the card connector in FIG. 2.
Figure 5:
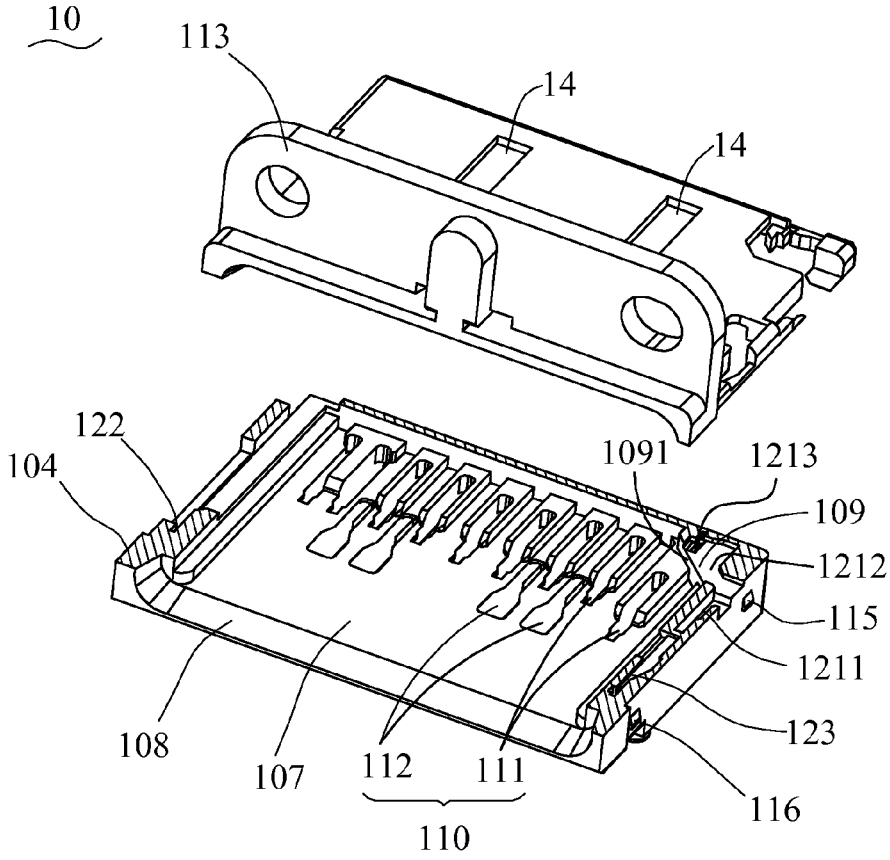
FIG. 5 is a cross section view of the insulating housing of the card connector in FIG. 4.

Please refer to FIG. 1 to FIG. 5. A preferred embodiment of a card connector 1 is a memory card connector capable of receiving a SD card and a MMC card. The card connector 1 includes an insulating housing 10, a plurality of contacts 20, a detecting contact 30, a ground contact 32, a protecting contact 60, a holding contact 70 and a shell 45. The detecting contact 30 and the ground contact 32 are together constructed a detecting contact set.

The insulating housing 10 is substantially formed as a thin shape and includes a top wall 101, a bottom wall 102 opposite to the top wall 101, a right wall 103, a left wall 104 opposite to the right wall 103, a rear wall 106 and a front surface 105. An extension wall 113 extends upwardly and perpendicularly from the top wall 101.

The insulating housing 10 is divided into a front section 11 and a rear section 12. The top wall 101, the bottom wall 102, the right wall 103 and the left wall 104 define a receiving space 107 therebetween. The front surface 105 defines an opening 108 which connects to the receiving space 107 for being inserted a memory card (not shown in figures). In this embodiment, lateral sides of the opening 108 are respectively formed as an arc-shaped.

The bottom wall 102 defines a plurality of grooves 110 for receiving the contacts 20. Specially, one end of each contact 20 is soldered to a printed circuit board (not shown in figures) and the other end connects to a corresponding pad of the memory card. The contacts 20 are divided into a first contact set 201 for adapting to the SD card and a second contact set 202 for adapting to the MMC card. Since, the grooves 110 are divided into a first groove set 111 for receiving the first contact set 201 and a second groove set 112 for receiving the second contact set 202.

A projection 109 is positioned in the receiving space 107 of the insulating housing 10 for preventing the memory card from improper insertion. Specially, the projection 109 is protruded from a corner where the right wall 103 connects to the rear wall 106. The projection 109 is integrated with the insulating housing 10. The projection 109 includes a slanting surface 1091 slanted relative to the rear wall 106 and the right wall 103.

A right side of the top wall 101 of the insulating housing 10 defines a receiving portion 121 which opens on the top wall 101 and includes a first slot 1211, a cavity 1212 and two holes 1213. The first slot 1211 extends downwardly into the right wall 103. The cavity 1212 is defined above the projection 109 and interconnected the first slot 1211 and the receiving space 107. The holes 1213 are respectively and perpendicularly extended downwardly to penetrate the bottom wall 102.

Specially, one of the holes 1213 directly connects to the first slot 1211 and penetrates through the right wall 103 and the other hole 1213 directly connects to the cavity 1212 and penetrates through the projection 109 (only shown the hole penetrating through the projection). The first slot 1211 is defined in front of the cavity 1212.

A left side of the top wall 101 of the insulating housing 10 defines a second slot 122 which opens on the top wall 101 and extends perpendicularly and downwardly into left wall 104. Also, the second slot 122 includes a hole (not shown in figures) extending downwardly and perpendicularly to penetrate the bottom wall 102. Also, the right side of the top wall 101 defines a third slot 123 which opens on the top wall 101 and positions in front of the first slot 1210. The third slot 123 extends downwardly and perpendicular into the right wall 103.

A plurality of posts 13 protrudes downwardly from the bottom wall 102 for positioning the card connector 1 on the printed circuit board. The rear section 12 of the insulating housing 10 defines two channels 14 on the top wall 101. The channels 14 respectively penetrate the top wall 101 and extend parallel with the right wall 103 and the left wall 104.

Specially, the level of a part of the top wall 101 within the front section 11 is slightly higher than the level of a part of the top wall 101 within the rear section 12. The extension wall 113 defines two apertures 114 at a middle portion thereof, which penetrate from a front surface and to a rear surface whereof. The apertures 114 are defined on the top wall 101. The right wall 103 and the left wall 104 respectively protrude two wedges 115, 116 laterally.

Figure 6:
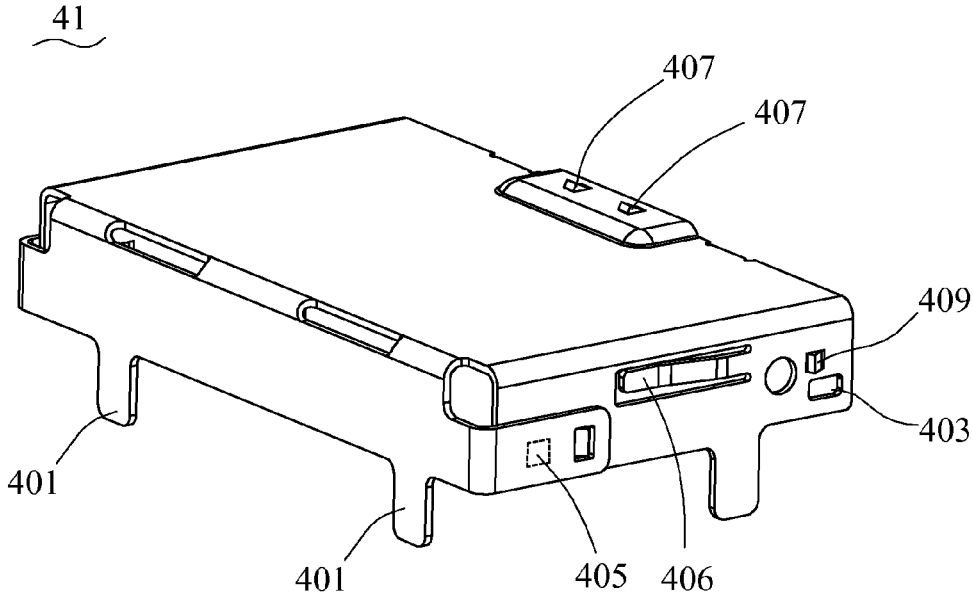
FIG. 6 is a perspective view of a rear shell of the card connector in FIG. 3.
Figure 7:
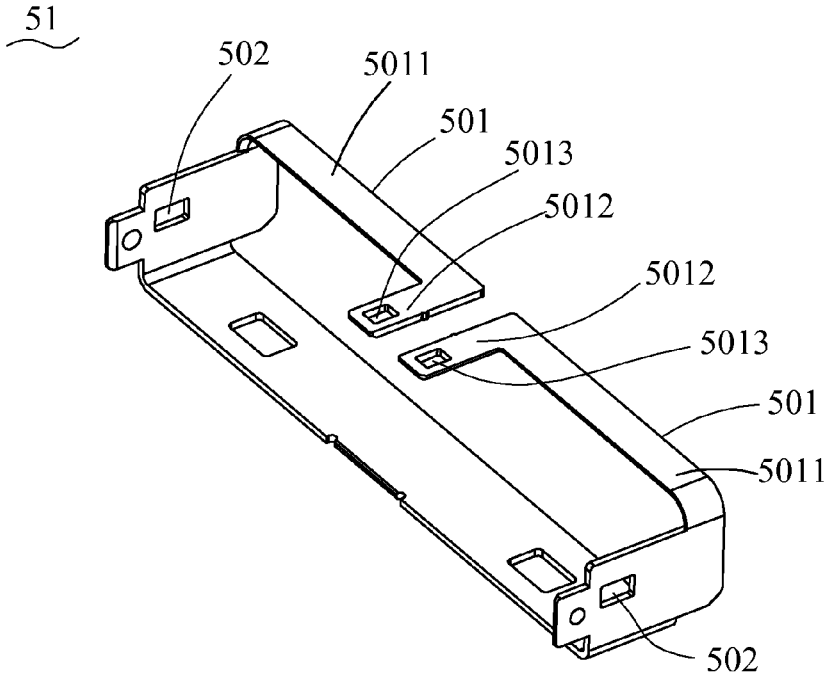
FIG. 7 is a perspective view of a front shell of the card connector in FIG. 2.
Figure 8:
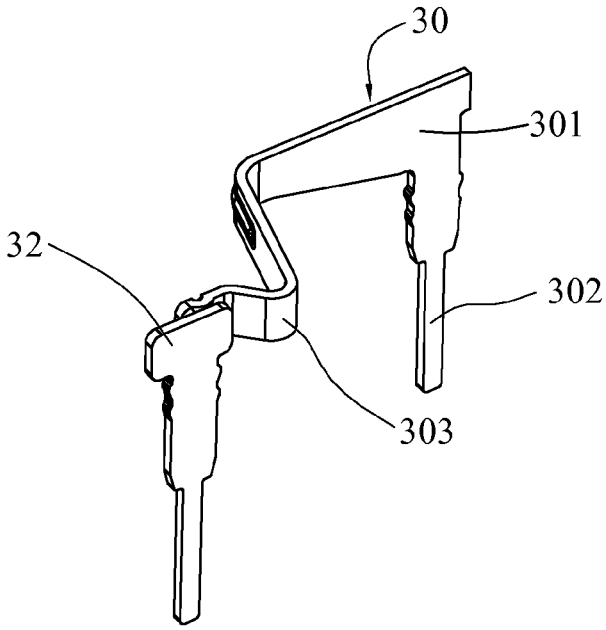
FIG. 8 is a perspective view showing a detecting contact connected to a ground contact.
Figure 9:
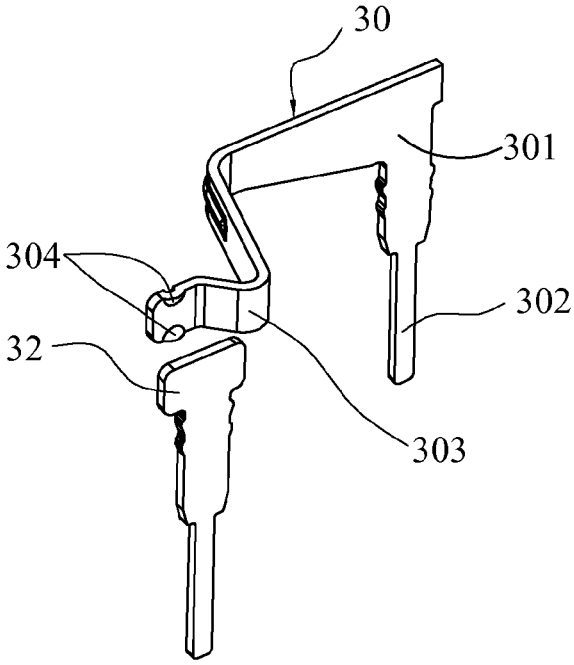
FIG. 9 is a perspective view showing the detecting contact separated from the ground contact.
Figure 10:
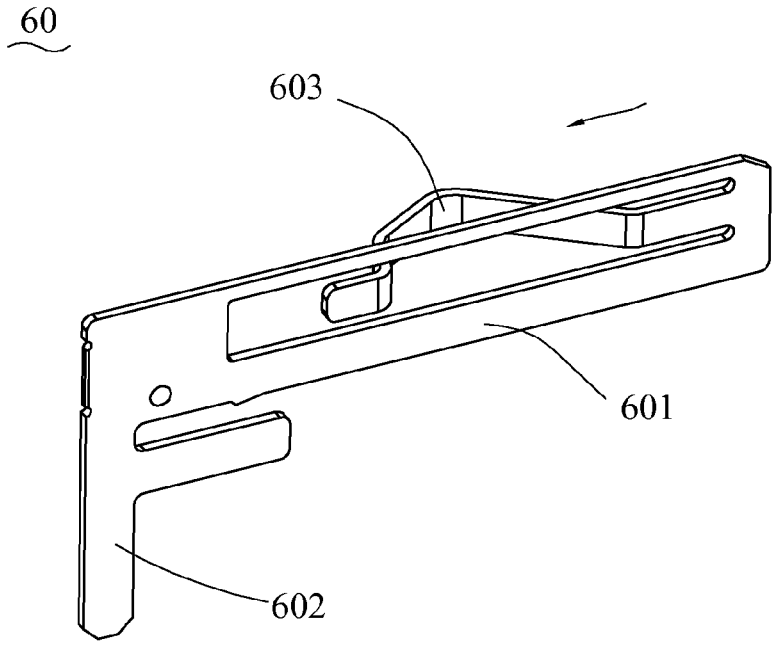
FIG. 10 is a perspective view of a protecting contact of the card connector in FIG. 2.
Figure 11:
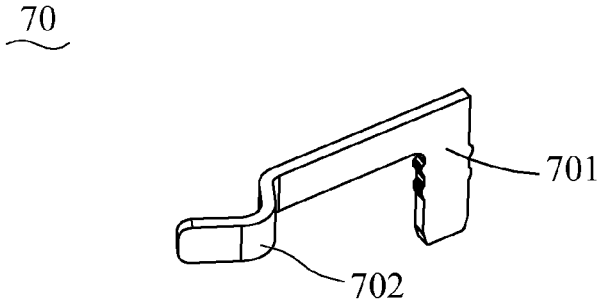
FIG. 11 is a perspective view of a holding contact of the card connector in FIG. 2.

Please refer to FIG. 6 and FIG. 7. The shell 45 shields the insulating housing 10 and includes a front shell 51 and a rear shell 41. The rear shell 41 is stamped of a metal foil, which includes a top plate, a pair of side plates and a rear plate. The rear shell 41 shields a part of each of the top wall 101, the right wall 103 and the left wall 104 within the rear section 12 of the insulating housing 10, and the rear wall 106.

The rear shell 41 includes a plurality of soldering legs 401 extending downwardly. Such that, the soldering legs 401 are soldered to the printed circuit board. Each side plate of the rear shell 41 defines two notches 403, 405 for engaging with the wedges 115, 116 of the insulating housing 10. Such that, the rear shell 41 can be engaged with the insulating housing 10. The top plate of the rear shell 41 is punched outwardly to form a pair of first tags 407. Each side plate of the rear shell 41 is punched outwardly to form a second tag 409 and punched inwardly to form a spring arm 406.

The front shell 51 is also stamped of a metal foil, which includes a top plate, a pair of side plates and a bottom plate. The front shell 51 shields a part of each of the top wall 101, the right wall 103, the left wall 104 and the bottom wall 106 within the front section 11 of the insulating housing 10. The top plate of the front shell 51 includes a pair of L-shaped arms 501. Each L-shaped arm 501 includes a connecting strip 5011 extending inwardly from each side plate and an engaging strip 5012 perpendicularly extending from the free end of the connecting strip 5011. The engaging strip 5012 defines an engaging hole 5013.

Each side plate of the front shell 51 defines a second notch 502. If the front shell 51 is assembled to the insulating housing 10, the engaging strip 5012 inserts through the aperture 114 of the insulating housing 10. The engaging hole 5013 of the front shell 51 engages with the first tag 407 of the rear shell 41. The second notch 502 of the front shell 51 engages with the second tag 409 of the rear shell 41 such that the front shell 51 can engage with the rear shell 41.

Please refer to FIGS. 1-5 and FIGS. 8-9. The detecting contact 30 and the ground contact 32 are received in the receiving portion 121 of the insulating housing 10. The protecting contact 60 is received in the second slot 122 of the insulating housing 10. The holding contact 70 is received in the third slot 123 of the insulating housing 10.

The detecting contact 30 includes a main portion 301, a soldering portion 302 and a contacting arm 303. The main portion 301 of the detecting contact 30 is received in the first slot 1211 of the receiving portion 121. The contacting arm 303 is extended from one end of the main portion 301 and received in the cavity 1212 of the receiving portion 121.

Specially, the contacting arm 303 of the detecting contact 30 is positioned above the projection 109. The contacting arm 303 of the detecting contact 30 is protruded from the slanting surface 1091 of the projection 109 and into the receiving space 107. Specially, the contacting arm 303 of the detecting contact 30 is punched to form a pair of bumps 304.

The soldering portion 302 of the detecting contact 30 is extended downwardly from the other end of the main portion 301 and received in the hole (not shown in the figures) which directly connects to the first slot 1211. The soldering portion 302 of the detecting contact 30 protrudes from the bottom wall 102 of the insulating housing 10 for being soldering to the printed circuit board.

The ground contact 32 is received in the other hole 1213 of the receiving portion 121. A top portion of the grounding contact 32 connects to the bumps 304 of the contacting arm 303 of the detecting contact 30, and a bottom portion protrudes from the bottom wall 102 of the insulating housing 10 for being soldering to the printed circuit board.

If the SD card is not yet inserted into the receiving space 107 or blocked by the projection 109 due to improperly insertion, the detecting contact 30 will connect to the ground contact 32 for presenting that the SD Card is not connected to the card connector 1 correctly and completely. If the SD card is inserted into the receiving space 107 correctly and completely, the contacting arm 303 of the detecting contact 30 is pushed by the SD card to separate from the ground contact 32 for presenting that the SD card is connected to the card connector 1 correctly and completely.

Please refer to FIGS. 1-4 and FIGS. 10-11. The protecting contact 60 is received in the second slot 122 of the insulating housing 10. The protecting contact 60 is stamped of a metal foil, which includes a main body 601, a soldering leg 602 and an elastic arm 603. The main body 601 is formed as a rectangular shape and received in the second slot 122.

The soldering leg 602 extends downwardly from one end of the main body 601 and penetrates the bottom wall 102 of the insulating housing 10 for being soldering to the printed circuit board. The elastic arm 603 is punched from the main body 601 and extends into the receiving space 107. Specially, the main body 601 and the elastic arm 602 are extended along the same direction.

The holding contact 70 is received in the third slot 123 of the insulating housing 10. The holding contact 70 includes a fixed portion 701 and an elastic holding arm 702. The fixed portion 701 of the holding contact 70 is fixed in the third slot 123. The elastic holding arm 702 extends from the fixed portion 701 and protrudes into the receiving space 107 for restricting the SD card in the receiving space 107 while the SD card is inserted correctly and completely.

As described above, due to the contacting arm 303 of the detecting contact 30 is protruded from the slanting surface 1091 of the projection 109 in the receiving space 107 of the insulating housing 10, the detecting contact 30 will be actuated while the SD card or the MMC card is inserted into the card connecter 1 correctly and completely. Since, the detecting accuracy of the card connector 1 is improved.

Due to the front shell 51 and the rear shell 41 respectively shield and engages with the front section 11 and rear section 12 of the insulating housing 10, and the engaging strip 5012 of the front shell 51 inserts through the aperture 114 of the insulating housing 10 and engages with the rear shell 41, the front shell 51 and the rear shell 41 can engage with the insulating housing 10 firmly.

Furthermore, the present invention is not limited to the embodiments described above; diverse additions, alterations and the like may be made within the scope of the present invention by a person skilled in the art. For example, respective embodiments may be appropriately combined.

What is claimed is:

1. A card connector, comprising:

an insulating housing comprising a bottom wall, a right wall and a left wall for defining a receiving space therebetween;

a plurality of contacts received in the insulating housing and extending into the receiving space;

a projection protruded from the right wall and into the receiving space, the projection comprising a slanting surface being slanted relative to the right wall; and a detecting contact set fixed in the insulating housing, the detecting contact set comprising a contacting arm protruding from the slating surface and into the receiving space.

2. The card connector as claimed in claim 1, wherein the contacting arm of the detecting contact set is positioned above the projection.

3. The card connector as claimed in claim 2, wherein the detecting contact set comprises a detecting contact with the contacting arm and a ground contact fixed to the projection and connected to the detecting contact.

4. The card connector as claimed in claim 3, wherein the projection is integrated with the right wall, the detecting contact is received in the right wall.

5. The card connector as claimed in claim 4, wherein the insulating housing comprises a rear wall connecting to the right wall to form a corner, the projection is protruded from the corner.

6. The card connector as claimed in claim 5, wherein the insulating housing comprises a top wall connected to the right wall and the rear wall, the right side of the top wall defines a first slot extending into the right side wall and a cavity defined above the projection and connected to the first slot, the detecting contact comprises a main portion received in the first slot and the contacting arm extended from the main portion and received in the cavity.

7. The card connector as claimed in claim 6, wherein the insulating housing comprises an extension wall extending upwardly from the top wall, a part of the insulating housing in front of the extension wall is shielded by a front shell, a part of the insulating housing in rear of the extension wall is shielded by a rear shell.

8. The card connector as claimed in claim 7, wherein the extension wall defines a least one aperture penetrating the extension wall from a front surface to the rear surface thereof, the rear shell comprises a top plate, the front shell comprises a top plate comprising an engaging strip extending through the aperture to engage to the top plate of the rear wall.

9. The card connector as claimed in claim 8, further comprising a protecting contact and a holding contact respectively received in the insulating housing.

10. A card connector, comprising:

an insulating housing having:

a receiving space;

an opening connected to the receiving space;

a projection with a slanting surface protruding from an inner corner where a rear wall connects to a right wall and into the receiving space;

a plurality of grooves;

a first slot defined in the right wall; and a cavity defined on the projection and interconnected the first slot and the receiving space;

a ground contact fixed to the projection;

a detecting contact fixed to the first receiving slot, the detecting contact having a contacting arm positioned above the projection and protruded into the receiving space, the contacting arm connected to the ground contact; and a shell shielding and engaging with the insulating housing.

11. The card connector as claimed in claim 10, wherein the contacting arm has a bump.

12. The card connector as claimed in claim 11, further comprising a protecting contact, the insulating housing defining a second slot for receiving the protecting contact.

13. The card connector as claimed in claim 12, further comprising a holding contact, the insulating housing defining a third slot for receiving the holding contact.

14. The card connector as claimed in claim 13, wherein the insulating housing extends outwardly to form an extension wall, the insulating housing is divided into a front section and a rear section by the extension wall, the shell comprises a rear shell shield for shielding the rear section of the insulating housing and a front shell for shielding the front section of the insulating housing and engaging with rear shell.

15. The card connector as claimed in claim 14, wherein the insulating housing has a top wall, a bottom wall opposite to the top wall, a left wall opposite to the right wall and a front surface, the rear shell shields a part of each of the top wall, the rear wall, the right wall and the left wall within the rear section, the front shell shields a part of each of the top wall, the bottom wall, the right wall and the left wall within the front section.

16. The card connector as claimed in claim 15, wherein the extension wall defines a pair of through apertures, the front shell has a pair of engaging strip and an engaging hole defined on each engaging strip, the rear shell is formed a pair of tags, the engaging strip inserts through the through aperture and engages with the tag of the rear shell.

17. The card connector as claimed in claim 16, wherein lateral sides of the opening are respectively formed as an arc-shaped.

18. A card connector, comprising:

an insulating housing defining a receiving space therein;

a plurality of contacts received in the insulating housing and extended into the receiving space;

a projection with a slating surface protruded from a side wall of the insulating housing, the slating surface being slanted relative to the side wall; and a detecting contact set fixed in the insulating housing, the detecting contact set having a contacting arm protruding from the slanting surface of the projection and into the receiving space.

19. The card connector as claimed in claim 18, wherein the detecting contact set comprises a detecting contact with contacting arm and a ground contact fixed to the projection for connecting to the detecting contact.

20. The card connector as claimed in claim 19, further comprising a front shell and a rear shell, the insulating housing has an extension wall extending outwardly and at least one aperture penetrating though the extension wall, the front shell shields a part of the insulating housing in front of the extending wall, the rear shell shields a part of the insulating housing in rear of the extending wall, the front shell having an engaging strip extending through aperture for engaging with the rear shell.

* * * * *